US011028655B2

(12) United States Patent
Wu et al.

(10) Patent No.: US 11,028,655 B2
(45) Date of Patent: Jun. 8, 2021

(54) ANTI-RECOIL CONTROL DESIGN USING A HYBRID RISER TENSIONING SYSTEM IN DEEPWATER DRILLING

(71) Applicant: Aspin Kemp & Associates Holding Corp., Montague (CA)

(72) Inventors: Yin Wu, Houston, TX (US); Edward Peter Kenneth Bourgeau, Houston, TX (US)

(73) Assignee: Aspin Kemp & Associates Holding Corp., Montague (CA)

( * ) Notice: Subject to any disclaimer, the term of this patent is extended or adjusted under 35 U.S.C. 154(b) by 0 days.

(21) Appl. No.: 16/561,899

(22) Filed: Sep. 5, 2019

(65) Prior Publication Data

US 2020/0199946 A1 Jun. 25, 2020

Related U.S. Application Data

(60) Continuation of application No. 15/961,595, filed on Apr. 24, 2018, now abandoned, which is a division of application No. 14/970,219, filed on Dec. 15, 2015, now Pat. No. 9,988,861.

(60) Provisional application No. 62/092,587, filed on Dec. 16, 2014.

(51) Int. Cl.
*E21B 19/00* (2006.01)
*E21B 33/038* (2006.01)

(52) U.S. Cl.
CPC ..... *E21B 19/006* (2013.01); *E21B 33/038* (2013.01)

(58) Field of Classification Search
CPC ..... E21B 19/006; E21B 33/038
See application file for complete search history.

(56) References Cited

U.S. PATENT DOCUMENTS 4,351,261 A * 9/1982 Shanks ..... B66C 13/02 114/264
4,617,998 A * 10/1986 Langner ..... E21B 19/09 166/345
4,759,256 A * 7/1988 Kovit ..... E21B 19/006 254/277
8,157,013 B1 * 4/2012 Trent ..... E21B 19/002 166/355

(Continued)

FOREIGN PATENT DOCUMENTS

WO WO-2012016765 A2 * 2/2012 ..... E21B 19/006
WO WO-2013096128 A1 * 6/2013 ..... E21B 19/006

*Primary Examiner* — James G Sayre
(74) *Attorney, Agent, or Firm* — Jones Robb, PLLC

(57) ABSTRACT

A riser data logging system can be installed on the riser top to provide real time information of the riser, instead of or in addition to relying on sensors installed on a tensioner. The riser recoil detection system can thus be made independent of any motion of the vessel. This logging system can feedback the riser top acceleration, velocity, position, and the wire-line tensions into a controller. By comparing the acceleration difference between the riser top and the vessel body, the controller can provide more reliable and faster detection of events occurring on a vessel, potentially detecting the condition within one second. If the acceleration exceeds a certain limit, the electrical tensioners are able to reduce the wire-line tension nearly instantaneously, providing a much more effective anti-recoil control that conventional hydro-pneumatic tensioners.

18 Claims, 14 Drawing Sheets

(56) References Cited

U.S. PATENT DOCUMENTS

| | | | | |
|---|---|---|---|---|
| 8,757,204 | B1 * | 6/2014 | Trent | E21B 19/006<br>137/601.16 |
| 2014/0331908 | A1 * | 11/2014 | Plain | E21B 19/09<br>114/122 |

* cited by examiner

ANTI-RECOIL CONTROL DESIGN USING A HYBRID RISER TENSIONING SYSTEM IN DEEPWATER DRILLING

CROSS-REFERENCE TO RELATED PATENT APPLICATIONS

This application is a continuation of U.S. patent application Ser. No. 15/961,595, filed Apr. 24, 2018, entitled "Anti-Recoil Control Design Using a Hybrid Riser Tensioning System in Deepwater Drilling," which is a divisional of U.S. patent application Ser. No. 14/970,219, filed Dec. 15, 2015 and entitled "Anti-Recoil Control Design Using a Hybrid Riser Tensioning System in Deepwater Drilling," (now U.S. Pat. No. 9,988,861) which claims the benefit of priority of U.S. Provisional Patent Application No. 62/092,587, filed Dec. 16, 2014 and entitled "Anti-Recoil Control Design Using the New Riser Hybrid Tensioning System in Deepwater Drilling," each of which is hereby incorporated by reference.

FIELD OF THE DISCLOSURE

This disclosure is related to riser control systems. More specifically, this disclosure is related to a riser tensioning control system having electrical tensioners.

BACKGROUND

Safety and performance are important considerations in a drilling riser. With trends over the past decades to exploit resources in deeper waters and harsher environments, ensuring the safety and performance of drilling risers has become a challenging task.

A riser tensioning system aims to compensate for relative motions between a floating drilling rig and the seabed, which are joined by a rigid riser string. In conventional systems, the most widely used riser tensioning system is a hydro-pneumatic riser tensioning system consisting of hydro-pneumatic cylinders, air/oil accumulators, and air pressure vessels. However, there are short-comings in hydro-pneumatic tensioning systems.

First, the response time for a hydro-pneumatic tensioning system is too slow for certain situations. The relatively slow operation of pneumatic systems results in a long control response time, which is the time between issuing a command and force being applied by the tension system. In certain situations, such as during an emergency riser disconnect, the tension changing response may be too slow. The slow, large over-pulling force may accelerate free riser pipes outward, allowing them to jump out, and consequently damage the drilling rig floor and riser pipes.

Second, increasing longitudinal over-pull tension, the conventional method in hydro-pneumatic tensioning systems used to suppress destructive vortex-induced vibration (VIV), causes stress on the supporting equipment, increases wear and tear on the tensioning system, and increases riser pipe fatigue. Furthermore, increasing longitudinal over-pull tension raises safety concerns in situations where a pair of hydro-pneumatic tensioners are receiving maintenance while the drilling rig is experiencing high wave conditions.

Third, a hydro-pneumatic tensioning system is a relatively complex and costly system that requires a significant amount of maintenance and is at risk for hydraulic fluid leakage. A hydro-pneumatic tensioning system includes a hydro-pneumatic cylinder rod and a seal that are exposed to bending due to factors such as vortex-induced vibration (VIV) or unequal and non-linear loading caused by vessel roll and pitch. These factors may cause high failure risk and may require a high maintenance cost to avoid hydraulic fluid leakage and risks of environmental pollution. Furthermore, the complex hydro-pneumatic system includes a significant volume of air accumulators and reservoirs that consume useful floor space on a drilling rig.

One important function of the tensioners is to control the drilling riser. The drilling riser is the connection between a platform at a water surface, such as a drilling vessel, and a subsea blowout preventer (BOP). The drilling riser circulates mud and cuttings and is an outer protection system for the drilling pipes and drill bit. Due to extreme handling, or harsh environmental conditions, a planned or emergency riser disconnect is probable. During this event, the riser is lifted up by the riser tensioning system. The elastic energy stored in the long riser string is released, and the riser "recoils." This event is considered to be high risk, because the amount of energy released and the rate of change of a heavy weight are tremendous. The anti-recoil operation mode of the riser tensioning system aims to perform the riser recoil process in a controlled manner. However, the slow response time of hydro-pneumatic tensioning systems described above can cause poor anti-recoil performance.

First, the anti-recoil system installed on current hydro-pneumatic tensioners is hard to test, because the only way to test is to perform a full length riser recoil. Potential catastrophic consequences may occur during such a test if the anti-recoil system does not work. In that event, it will take weeks of work to recover and is a big loss for both operator and drilling contractor.

Second, riser recoil detection is ineffective on the hydro-pneumatic tensioners, by only relying on sensors installed on vessel, which is highly dependent on vessel motion, and other effects.

Third, the slow response time of the hydraulic and pneumatic equipment during an emergency disconnect situation is insufficient. The slowly-changed large over-pulling force may accelerate the riser to jump out and damage the drill floor and the riser pipes.

SUMMARY

An anti-recoil control design implemented by a hybrid tensioning system on a riser may provide more robust control and precision in the event of a drilling riser disconnect, in addition to improved testing capabilities, over that present in conventional hydro-pneumatic tensioning systems. The improved control and precision in the event of a drilling riser disconnect may enhance overall safety and reliability of a deepwater riser system while additionally allowing for testing of various disconnect scenarios with relative safety. In particular, electrical tensioners have a more rapid response time and greater precision of control than hydro-pneumatic tensioners. The quick response time may be advantageously employed to perform anti-recoil functions. This anti-recoil control design for a riser hybrid tensioning system provides increased precision and flexibility in control, as well as additional possibilities for test scenarios, thus enhancing reliability and safety.

The system may include a drilling riser, a vessel, a first data logging system coupled to a vessel, a second data logging system coupled to the top of the drilling riser, an array of electrical tensioners coupled to the drilling riser via an array of wires, one or more hydro-pneumatic tensioners coupled to the drilling riser via one or more wires, and a controller, coupled to and controlling the tensioners and receiving data from the first and second data logging systems. The first data logging system sends data to the controller regarding the acceleration, velocity, and position of the vessel itself. The second data logging system sends data to the controller regarding the acceleration, velocity, and position of the top of the drilling riser. The controller then estimates the properties of the entire drilling riser based on the data regarding the top of the drilling riser and data as to the properties of the drilling riser that are constant. A vessel as referred to throughout this document may refer to a ship, a platform, or any other sea capable structure or vehicle.

When the drilling riser disconnects from a blowout preventer, the first goal of the anti-recoil system is to create as much distance between the lower marine riser package, or the bottom of the drilling riser, and the blowout preventer as possible. To that effect, when the data as to the acceleration, velocity, and position of the drilling riser relative to the position of the blowout preventer indicates that a disconnect has occurred, the controller is configured to cause the electrical tensioners to apply a maximum tension to the wires to which they are coupled in order to create a maximum distance between the drilling riser and the blowout preventer as fast as possible. The goal is to prevent a collision between the lower marine riser package and the blowout preventer.

After the maximum tension has been applied, however, a risk arises that the top of the drilling riser may collide with the vessel. The controller is configured to compare the first data, regarding the acceleration, velocity, and position of the vessel, with the second data regarding the acceleration, velocity, and position of the top of the drilling riser. Through this comparison, the controller can calculate the difference between the acceleration of the top of the drilling riser and the acceleration of the vessel in order to determine if a collision is forthcoming. If the calculation shows that a collision is imminent, the controller is configured to cause the electrical tensioners to reduce the tensions applied to the wires to which they are coupled in order to slow the acceleration of the riser and thus avoid a collision.

Then, after the risk of a collision between the top of the drilling riser and the vessel has been averted, the controller will compare the second data regarding the position of the drilling riser with a desired position of the drilling riser and cause the electrical tensioners to slowly increase the tension applied to the wires in order to bring the drilling riser into the desired position.

Some hydro-pneumatic tensioners have anti-recoil valves that can be used to combat recoil in disconnect scenarios. In a hybrid anti-recoil system proposed, the controller can keep the anti-recoil valves of the hydro-pneumatic tensioners open in order to enhance the control and predictability of the system. However, when the controller determines that a collision is imminent and that the anti-recoil capabilities of the electrical tensioners may not be sufficient to prevent it, the controller may close the anti-recoil valves of the hydro-pneumatic tensioners in order to supplement the anti-recoil capabilities of the electrical tensioners.

Systems including the features described herein may allow for enhanced testing capabilities, because electrical tensioners allow for much greater precision than conventional hydro-pneumatic tensioners. The controller can be configured to cause the electrical tensioners to apply a tension to the wires to which they are attached in order to retract the drilling riser less than it would in a full disconnect scenario. This can allow for testing of the anti-recoil capabilities of a system with far less risk than that present in conventional, purely hydro-pneumatic systems as the forces applied when partially retracting the drilling riser from the blowout preventer are far less than those that would be present in a full disconnect.

According to one embodiment, an apparatus includes a first and second electrical tensioner mechanically coupled to a drilling riser via a first and second wire of a plurality of wires. The apparatus may also include a first data logging system coupled to a vessel, which may be configured to generate data regarding the acceleration, velocity, and position of the vessel. Additionally, the apparatus may include a second data logging system coupled to a drilling riser, which may be configured to generate data regarding the acceleration, velocity, and position of the drilling riser. The second data logging system may be attached to the top of the drilling riser and may be further configured to generate data regarding more specifically the acceleration, velocity, and position of the top of the drilling riser. The apparatus may further include a hydro-pneumatic tensioner mechanically coupled to the drilling riser via a third wire of the plurality of wires. Further, the apparatus may include a controller configured to measure the tension and speed delivered by the first and second electrical tensioners and the hydro-pneumatic tensioner. The controller may also be configured to determine the tension for the first and second electrical tensioners based, in part, on a comparison of the data generated by the first data logging system with the data generated by the second data logging system. The controller may be configured to compare the data regarding the properties of vessel with the data regarding the properties of the drilling riser, in order to determine optimal tension application. Finally, the controller may be configured to control the first and second electrical tensioners to apply the determined tension to the first and the second wires, potentially adjusting the length of the first and the second wires.

Further, the controller may be configured to respond to a disconnect between a lower marine riser package and a blowout preventer. In the event of a disconnect, the controller may be configured to distribute a maximum tension to the first and the second wires in order to prevent a collision between the lower marine riser package and the blowout preventer. The maximum tension may be applied for a period of time calculated based on a position of the blowout preventer and the first data regarding the properties of the drilling riser.

After a sufficient distance is achieved between the lower marine riser package and the blowout preventer, a situation may arise where there is a concern that the top of the drilling riser may impact the floor of the vessel. In order to remedy such a situation, the first data logger may be configured to continuously feed data comprising the acceleration of the vessel to the controller, and the second data logger may be configured to continuously feed data comprising the acceleration of the top of the drilling riser to the controller. The controller may be further configured to continuously calculate the difference between the acceleration of the top of the drilling riser and the acceleration of the vessel. In the event of a disconnect, a sudden increase in the difference between the acceleration of the top of the drilling riser and the acceleration of the vessel is to be expected given the aforementioned application of a maximum tension. Therefore, the controller may be configured to reduce the tension applied to the first and second wires at a rate necessary to avert a collision between the top of the drilling riser and the vessel when the difference between the acceleration of the top of the drilling riser and the acceleration of the vessel reaches a predetermined value.

After such a collision between the top of the drilling riser and the floor of the vessel has been averted, the controller may be configured to gradually increase the tension applied to the first and the second wires in order to bring the drilling riser into a position in which the data regarding the position of the drilling riser is in accordance with a predetermined set of data describing a desired position of the drilling riser.

The controller may be further configured to allow for testing of the anti-recoil features of the system. The controller may be configured to retract the lower marine riser package from the blowout preventer to a lesser extent than that present in a full disconnect. The controller may be further configured to dynamically adjust the extent of retraction desired. Finally, the controller may be configured to retract the blowout preventer to a degree set by an operator.

Finally, the anti-recoil capabilities of the first and the second electrical tensioners may be supplemented by the hydro-pneumatic tensioner. The hydro-pneumatic tensioner may be equipped with an anti-recoil valve. To further supplement the predictability of the anti-recoil functionality of the first and the second electrical tensioners, the anti-recoil valve may of the hydro-pneumatic tensioner may be kept open during conventional operation of the anti-recoil apparatus. However, when the first data indicates an acceleration of the drilling riser that exceeds a predetermined limit, the controller may cause the anti-recoil valve of the hydro-pneumatic tensioner to open, thereby supplementing the anti-recoil capabilities of the first and the second electrical tensioners.

The foregoing has outlined rather broadly certain features and technical advantages of embodiments of the present invention in order that the detailed description that follows may be better understood. Additional features and advantages will be described hereinafter that form the subject of the claims of the invention. It should be appreciated by those having ordinary skill in the art that the conception and specific embodiment disclosed may be readily utilized as a basis for modifying or designing other structures for carrying out the same or similar purposes. It should also be realized by those having ordinary skill in the art that such equivalent constructions do not depart from the spirit and scope of the invention as set forth in the appended claims. Additional features will be better understood from the following description when considered in connection with the accompanying figures. It is to be expressly understood, however, that each of the figures is provided for the purpose of illustration and description only and is not intended to limit the present invention.

BRIEF DESCRIPTION OF THE DRAWINGS

For a more complete understanding of the disclosed system and methods, reference is now made to the following descriptions taken in conjunction with the accompanying drawings.

DETAILED DESCRIPTION

Figure 1A:
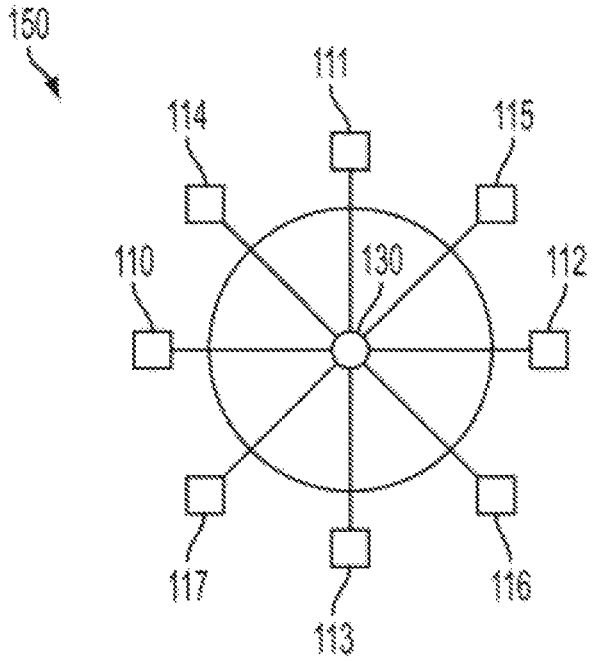
FIG. 1A is a block diagram illustrating a top view of a riser electrical tensioning system according to one embodiment of the disclosure.

A riser data logging system can be installed on the riser top to provide real time information of the riser, instead of or in addition to relying on sensors installed on a tensioner. The riser recoil detection system can thus be made independent of any motion of the vessel. This logging system can feedback information such as the riser top acceleration, velocity, position, and the wire-line tensions into a controller. By comparing the acceleration difference between the riser top and the vessel body, the controller can provide more reliable and faster detection of events occurring on a vessel, potentially detecting the condition within one second. If the acceleration exceeds a certain limit, the electrical tensioners are able to reduce the wire-line tension nearly instantaneously, providing a much more effective anti-recoil control that conventional pneumatic tensioners.

A mathematical model detailed below describes dynamic behavior for both normal operation and operation during riser recoil. The model includes a riser string with mud flow discharge, a hydro-pneumatic tensioner with anti-recoil valve, and an electrical tensioner. A Kalman estimator of the position and velocity of the riser string can be executed by a controller, such that the displacement of the riser bottom, or any other depth along the riser string, can be detected based on information received from the logging system. A position control strategy can be implemented by the controller with an objective of moving the riser body to a desired elevation height in a predictive manner. The controller may be configured to execute as a linear feedback controller by using the Linear-Quadratic Regulator (LQR) method.

When a hydro-pneumatic tensioner is part of the system, anti-recoil equipment installed in the hydro-pneumatic tensioners can be kept open during the riser recoil process to increase the predictability of the whole riser system. The tension in electrical tensioners can be controlled to be increased to near maximum values, such that the electric tensioner lifts the Lower Marine Riser Package (LMRP) from the blow out preventer (BOP) fast and straight to avoid any collision or damage. Then, the tension is reduced rapidly to avoid hitting the rig floor. Before the riser reaches the target height, the electrical tensioners can reversely increase tension slowly to lift the weight of the riser to the target position gradually. On the other hand, the hydro-pneumatic tensioners are able to reverse the tension easily within short time span. Therefore, the behavior of both riser position and tension delivered by the dynamically controlled electrical tensioner can be made very predictable.

This riser hybrid tensioning system makes the riser system more testable. For example, the lifting height of the LMRP can be set as an adjustable parameter in the control firmware, which can be changed during operation. Instead of lifting the riser the full retraction of, for example, 30 feet, it can be set to be only 1 A of the full retraction. Therefore, the risk of damage is reduced, and, more importantly, it allows the functionality tests to be performed more often to improve an operator's confidence, which is reduced exponentially by time since the last test.

The electrical tensioner could still be under position control mode, during the normal operation of active heave compensation when the riser bottom is connected to the sea bed. The target displacement of the riser top can be set to lift, for example, five feet, by simply typing the value into computer. The lower maximum tension limit of the electrical tensioners is set to the nominal tension calculated by riser engineers. In this way, the electrical tensioners always provide the nominal required tension, and the whole riser string keeps under tension during this operation mode. This operation method may significantly increase the vessel predictability. Especially for an unplanned riser parting incident, the riser top position will be safely lifted by a certain distance, instead of any overshot due to the lighter weight of the broken riser string. Furthermore, any part of the riser string can be set to a target position.

During riser recoil process, there may be scenario that the riser is still accelerating, at the moment that the tension of all electrical tensioners hits the minimum, this indicates that the over-pull tension of the riser string is still bigger than the capability of the electrical tensioner. The tension of the hydro-pneumatic tensioners should start to reduce now, by switching on an additional Air Pressure Vessel (APV), or shut down the anti-recoil valves. In the case that the riser is decelerating, at the moment that the tension of all electrical tensioners hits minimum, the predicted remaining tension ring displacement can be calculated rapidly and decide whether the tension of hydro-pneumatic tensioners should be reduced, in order to prevent the riser top hitting the drill floor.

A tensioning system implementing electrical tensioners alone or in combination with hydro-pneumatic tensioners in a hybrid system is described in the following figures. FIG. 1A is a block diagram illustrating a top view of a riser electrical tensioning system 150 according to one embodiment of the disclosure. A riser 130 may be coupled to the electrical tensioners 110-117 by ropes. Although FIG. 1A depicts the electrical riser tensioning system 150 with eight electrical tensioners 110-117, the electrical riser tensioning system 150 is not limited to this specific number of electrical tensioners 110-117. For example, in another embodiment, an electrical riser tensioning system may include four electrical tensioners.

Figure 1B:
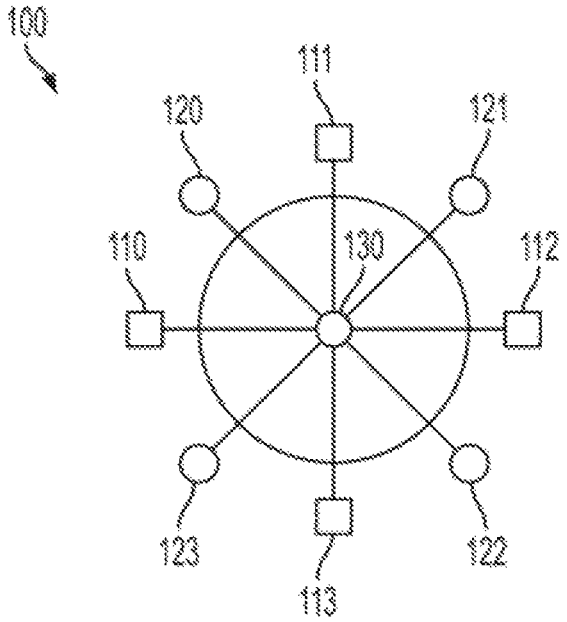
FIG. 1B is a block diagram illustrating a top view of a riser hybrid tensioning system according to one embodiment of the disclosure.

FIG. 1B is a block diagram illustrating a top view of a riser hybrid tensioning system 100 according to one embodiment of the disclosure. The riser 130 may be coupled to electrical tensioners 110-113 and hydro-pneumatic tensioners 120-123 by ropes. Together the electrical tensioners 110-113 and hydro-pneumatic tensioners 120-123 may form the riser hybrid tensioning system 100. Although many of the short-comings of riser tensioning systems that employ only hydro-pneumatic riser tensioners 120-123 have already been detailed, hydro-pneumatic tensioners 120-123 may be used in a riser hybrid tensioning system 100 to take advantage of the benefits of hydro-pneumatic tensioners 120-123. For example, a riser hybrid tensioning system 100 with hydro-pneumatic tensioners 120-123 may have good reliability because the hydro-pneumatic tensioners 120-123 are passive and self-contained systems that have no energy exchange with external systems. Furthermore, the riser hybrid tensioning system 100 may be more resistant to disturbances and fluctuations of outside systems. Electrical riser tensioners 110-113 add many advantages, such as delivering dynamically variable torque with high accuracy, providing quick control responses, and being easier to install. A riser hybrid tensioning system 100 may therefore benefit from the combined advantages of hydro-pneumatic tensioning systems 120-123 and electrical tensioners 110-113.

Although FIG. 1B depicts the riser hybrid tensioning system 100 with four electrical tensioners 110-113 and four hydro-pneumatic tensioners 120-123, a riser hybrid tensioning system is not limited to this specific number of electrical tensioners and hydro-pneumatic tensioners. For example, in another embodiment, a riser hybrid tensioning system may include six hydro-pneumatic tensioners and four electrical tensioners.

Figure 2A:
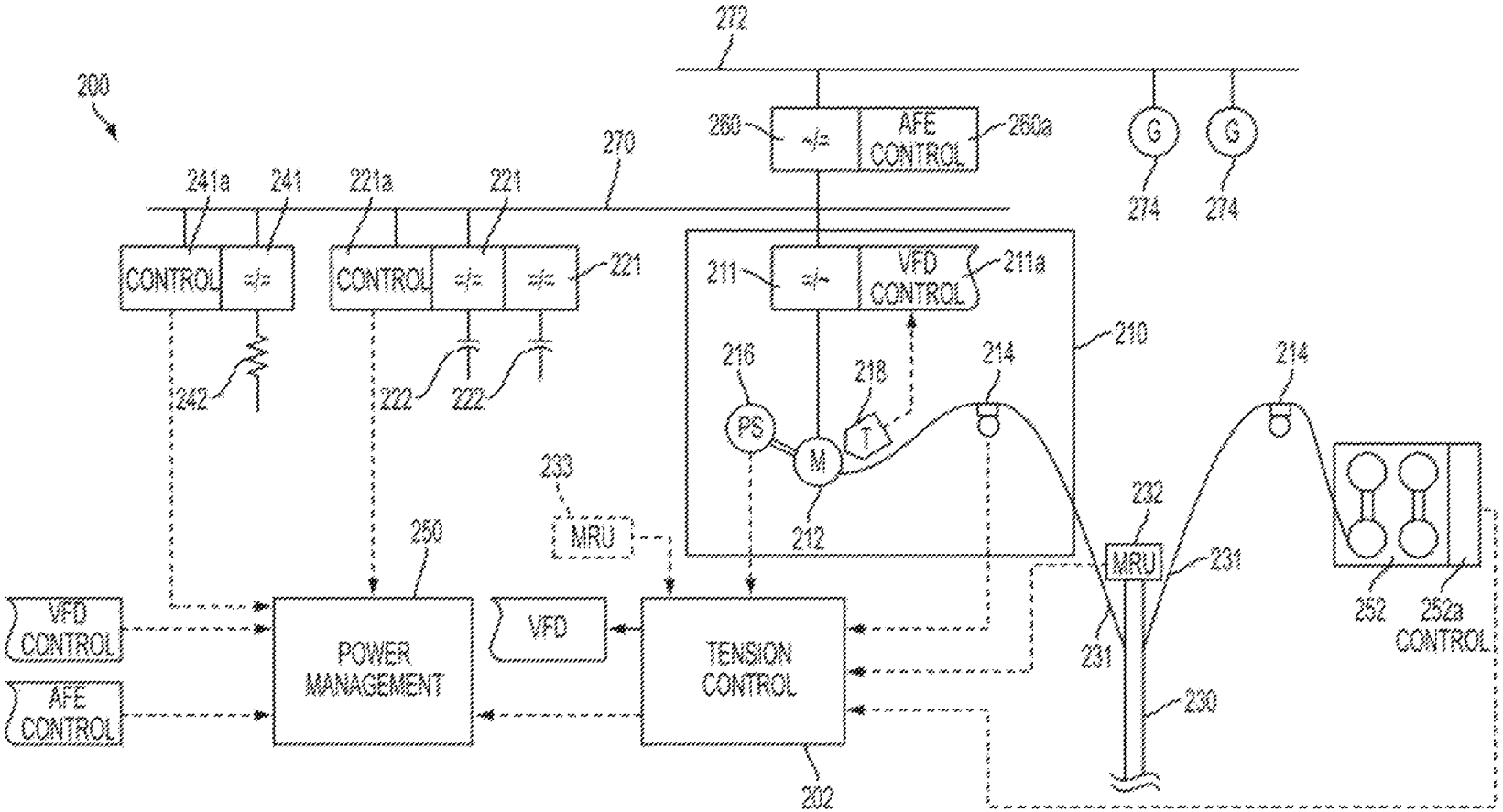
FIG. 2A is block diagram illustrating a riser tensioning system according to one embodiment of the disclosure.
Figure 2B:
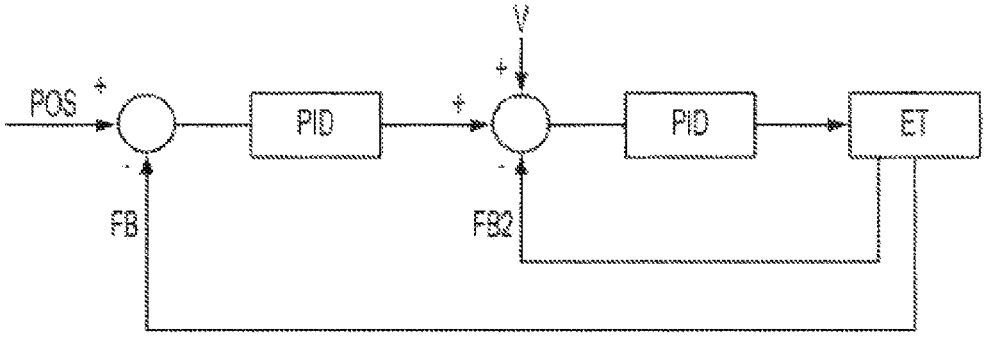
FIG. 2B is a block diagram illustrating a controller for the riser tensioning system according to one embodiment of the disclosure.

FIG. 2A is block diagram illustrating a riser tensioning system 200 according to one embodiment of the disclosure. The tensioning system 200 may be used to control the tension of wires 231 coupling electrical tensioners 210 to a drilling riser 230. Although only one electrical tensioner 210 is illustrated, additional electrical tensioners may be present, such as illustrated in FIG. 1A above.

The electrical tensioner 210 may be coupled to a common DC power distribution bus 270, which may be shared with other electrical tensioners. The DC bus 270 provides a physical link for the energy flowing into and out of the tensioning system 200, as well as for other power devices. The DC bus 270 may be coupled to an active front end (AFE) rectifier 260 that converts power from an AC bus 272 powered by one or more generators 274. The power module of the AFE rectifier 260 may be controlled by a power management system 250 through an AFE controller 260*a*.

The electrical tensioner 210 may include a variable frequency drive (VFD) 211 to invert energy from AC to DC or from DC to AC. The VFD-type inverter 211 may be controlled by the tension controller 202 through a VFD controller 211*a*. In one direction, the inverter 211 may convert DC energy from the DC bus 270 to AC energy for use by the electrical tensioner 210. In another direction, the inverter 211 may convert AC energy from the electrical tensioner 210 to DC energy that is transferred onto the DC bus 270.

The electrical tensioner 210 may also include a motor 212 coupled by the wire 231 to a sheave 214 and to the riser 230. The motor 212 may be, for example, a high-torque low-speed machine. The motor 212 may be a direct-drive motor, such as an axial-flux permanent magnet disc motor. The motor 212 may be controlled by the VFD 211. A position sensor (PS) 216 may be coupled to the electrical tensioner 210 to measure the motor rotating position and to report the position to a tension controller 202. A temperature sensor 218 may be located inside or on the motor 218 and provide feedback to a VFD controller 211*a*. For example, when a temperature measured by the sensor 218 exceeds a safe level, the circulation of an auxiliary cooling system may be increased, or the motor 218 may be shut down to reduce its temperature.

In an all-electric tensioning system, such as illustrated in FIG. 1A, multiple electric tensioners may be coupled to the riser 230 by wires 231. When the tensioning system 200 is a hybrid system, such as illustrated in FIG. 1B, the system 200 may include a hydro-pneumatic tensioner 252 with associated controller 252*a*. Although only one hydro-pneumatic tensioner 252 is illustrated, multiple hydro-pneumatic tensioners may be coupled to the riser 230 through the wires 231. The controller 252*a* may also be in communication with the tension controller 202.

The tension controller 202 may be configured to perform many tasks within a hybrid or electrical riser tensioning system and provide feedback to the power management controller 250. For example, the controller 202 may regulate the torque in the motor 212 for different control purposes through different control algorithms. As another example, the controller 202 may be used as a load sharing controller that distributes tension between the hydro-pneumatic tensioner 252 and the electrical tensioner 210. Furthermore, the controller 202 may be configured to dynamically control the wireline 231 tension. For monitoring and control purposes, status feedback of the electrical tensioners 210, the hydro-pneumatic tensioners 252, the riser 230 and the drilling vessel on which the riser tensioning system is employed may be sent to the controller 202. Alternatively, the controller 202 may calculate the reference signals for both electrical and the hydro-pneumatic tensioners using different control algorithms. The algorithms may be based, in part, on the riser top and the drilling vessel heave relative positions to the seabed, velocity and acceleration from the motion reference unit (MRU) 232, a MRU 233 on the vessel (not shown), and tension measurements of the electrical tensioner 210 and the hydro-pneumatic tensioner 252. Moreover, the controller 202 may be configured to monitor the routing of energy in and out of the electrical tensioner 202 and send this energy signal into the power management controller 250.

The power management controller 250 may be configured to monitor the DC bus 270 voltage and the AC bus 272 frequency. Furthermore, the controller 250 may coordinate power among other power components, such as the electrical tensioner 210, the ultracapacitor bank 222, and the power dissipater 242.

Referring back to FIG. 2A, in normal operation, a drilling vessel having a riser hybrid tensioning system may experience wave motion that transfers large amounts power to and/or from the electrical tensioner 210. For example, when the vessel experiences waves that cause the vessel to move upward, the electrical tensioner 210 may consume energy from the rig power network. The energy consumed by the electrical tensioner 210 may be in the megajoule range, and the required peak power may then be in the megawatt range. When the vessel experiences waves that cause the vessel to move downward, the electrical tensioner 210 may release the same power back onto the DC bus 270. Power fluctuations from the waves may be compensated with elements 222 and 242. That is, by storing energy returned to the DC bus 270 by the energy storage elements 222 or dissipating the energy in energy dissipation elements 242.

The energy storage elements 222 may be coupled to the DC bus 270. Each energy storage element 222 may be coupled to a DC/DC power chopper (DDPC) 221. The specific number and type of energy storage devices 222 used for the energy storage elements 222 may depend on application specific parameters, such as the type of vessel used or the space available for the energy storage elements 222. An energy storage device 222 may be, for example, an ultracapacitor bank (UCB) a battery bank, or a flywheel. When the UCB is used for the energy storage device 222, the UCB may be selected to have a capacity at least 1.2 times the maximum of both the vessel heave of the most significant sea state criterion and five times of the UCB's capacity de-rating.

The tensioning system 200 may also include a power dissipater 242 coupled to the DC bus 270 through a unidirectional power chopper 241. The unidirectional power chopper 241 which may regulate the amount of energy to be dissipated by the power dissipater 242. The power dissipater 242 may be any device that consumes energy, such as a resistor or a heat sink. Operation algorithms within the power management system 250 may route energy into power dissipaters 242 when the energy storage devices 222 are fully charged or when the operating voltages of the UCBs exceed a maximum operating voltage.

Figure 3:
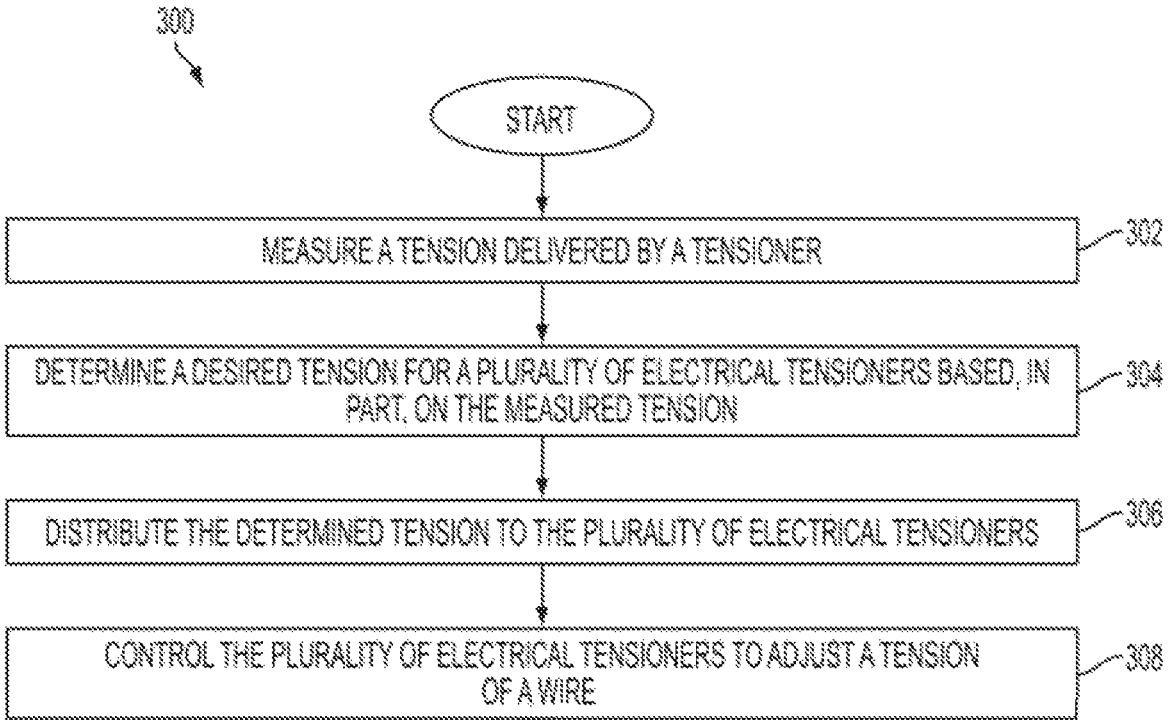
FIG. 3 is a flow chart illustrating a method for controlling the tension of a riser tensioning system according to one embodiment of the disclosure.

FIG. 3 shows a flow chart illustrating a method 300 for controlling the tension of a riser tensioning system according to one embodiment of the disclosure. The method 300 begins at block 302 with measuring a tension delivered by a tensioner within the riser tensioning system. The measured tension may be the tension delivered by a hydro-pneumatic tensioner or an electrical tensioner. In one embodiment, a controller, such as the controller 202 of FIG. 2A, may receive tension feedback signals delivered by the hydro-pneumatic or electrical tensioner to obtain the measured tension delivered by either the hydro-pneumatic or electrical tensioner. In certain embodiments, a plurality of hydro-pneumatic and/or electrical tensioners may be monitored by the controller. In one embodiment, a controller, such as the controller 202 of FIG. 2A, may measure the tension delivered by the hydro-pneumatic or electrical tensioners, while in tensioner.

At block 304, a desired tension for a plurality of electrical tensioners may be determined based, in part, on the measured tension at block 302. Other parameters that may be used to determine the desired tension for a plurality of electrical tensioners include the tension delivered by a hydro-pneumatic or electrical tensioner, a total required tension of the entire riser tensioning system, a total number of hydro-pneumatic tensioners in a riser hybrid tensioning system, and/or a total number of electrical tensioners in the system. Furthermore, the controller 202 of FIG. 2A may be configured to determine the desired tension of the electrical tensioner based, in part, on monitored parameters of a drilling vessel, such as the total number of hydro-pneumatic and electrical tensioners on the vessel.

At block 306, the desired tension of block 304 may be distributed to the plurality of electrical tensioners. The plurality of electrical tensioners may then be controlled to deliver the determined tension by evenly rolling in or rolling out a wire coupled to a respective electrical tensioner of the plurality of electrical tensioners.

According to one embodiment, the desired tension of an electrical tensioner, or a plurality of electrical tensioners, may be calculated using the following equation:

$$T_{ETi}(t) = \left(T_{Total}(t) - \sum_{i=1}^{n_{HT}} T_{HTi}(t)\right) / n_{ET},$$

where $T_{ETi}$ may denote the desired tension of an individual electrical tensioner i, and $T_{HTi}$ may be the tension delivered by hydro-pneumatic tensioner i at any given time, and $T_{Total}$ may represent the total desired tension of the entire riser hybrid tensioning system. The $n_{HT}$ and $n_{ET}$ parameters may be the total number of hydro-pneumatic and electrical tensioners, respectively, in the system.

At block 308, the plurality of tensioners may be controlled based, in part, on the tension that was determined at block 304 and that was distributed at block 306. For example, the tensioners may apply a tension to the wires. The plurality of electrical tensioners may be controlled and coordinated to satisfy different control purposes. This may assist in stabilizing a riser in an offshore drilling vessel. For example, the measuring of the tension delivered by tensioners may be performed continuously to dynamically calculate the desired tension of a tensioner and control the tension being delivered by tensioners. This may ensure that the total delivered tension by the hydro-pneumatic and/or electrical tensioners remains nearly constant. In one embodiment, the controller 202 of FIG. 2A may be configured to control the plurality of electrical tensioners and adjust the wireline tension according to different drilling operation and sea condition. The actions disclosed at the blocks of FIG. 3 may be performed continuously.

Figure 4:
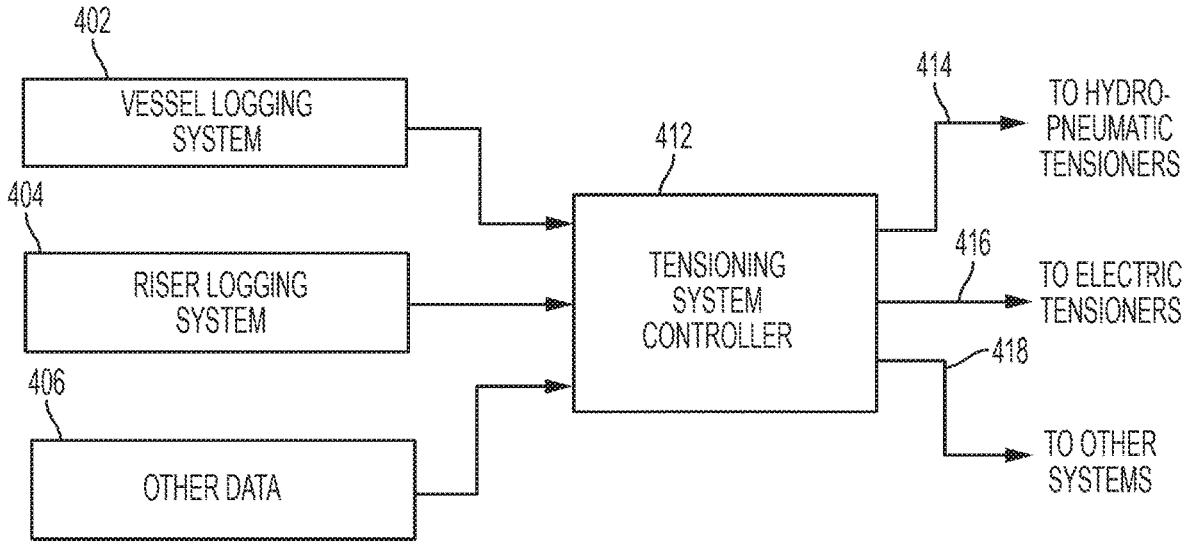
FIG. 4 is a block diagram illustrating a controller for a plurality of electric tensioners, such as in a hybrid riser tensioning system, according to one embodiment of the disclosure.

One embodiment of a controller for a tensioner system with electric tensioners is shown in FIG. 4. FIG. 4 is a block diagram illustrating a controller for a plurality of electric tensioners, such as in a hybrid riser tensioning system, according to one embodiment of the disclosure. The controller of FIG. 4 may be, for example, implemented as tension control 202 in FIG. 2A. A tensioning system controller 412 may be configured to receive data from a vessel logging system 402, a riser logging system 404, and/or other data systems 406. For example, the controller 412 may be coupled to the data systems 402, 404, and 406 through wired or wireless communications. The controller 412 may be programmed through software or firmware to process data received from the data systems 402, 404, and 406. Further, the controller 412 may be coupled to memory for storing data or computations for either short terms or long terms. After processing received data in accordance with its software or firmware, the tensioning system controller 412 may generate control signals designed to operate or provide instructions for how to operate tensioners in the tensioning system and/or other components of a drilling vessel. For example, the tensioning system controller 412 may generate control signal 414 for controlling one or more hydro-pneumatic tensioners, may generate control signal 416 for controlling one or more electric tensioners, and/or may generate control signals 418 for controlling other systems.

Figure 5:
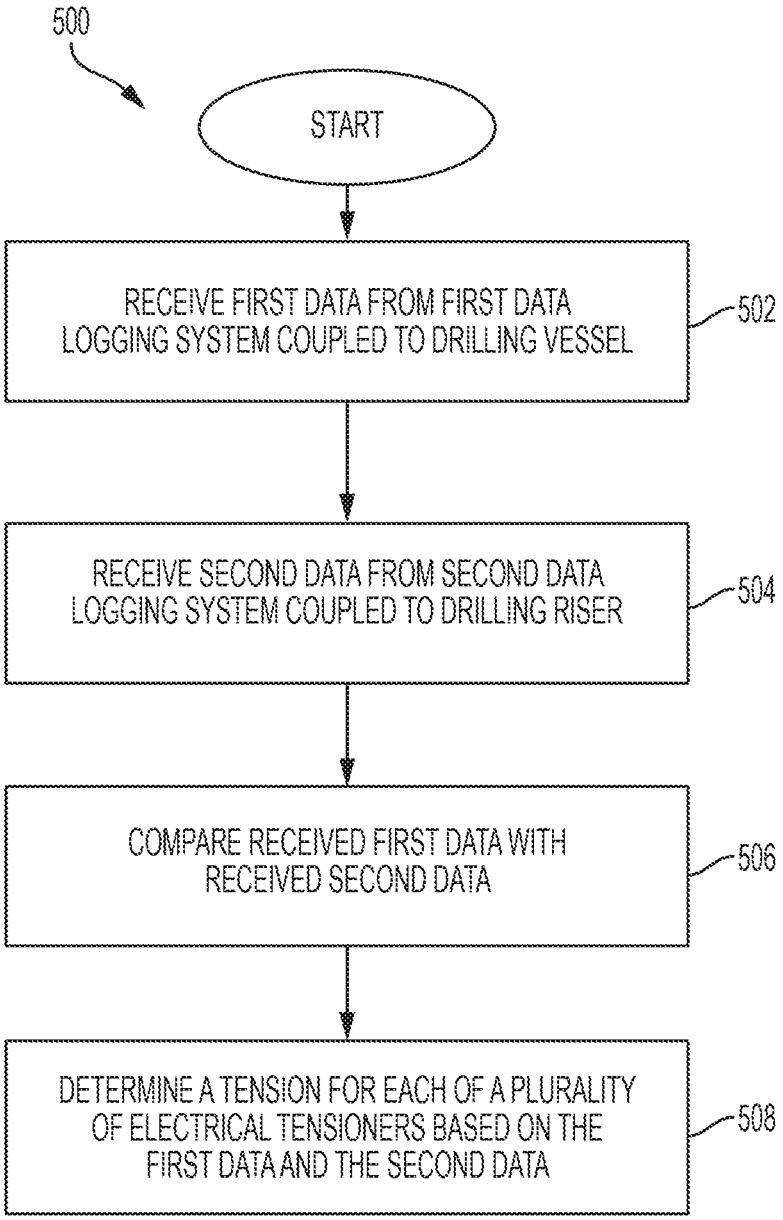
FIG. 5 is a flow chart illustrating a method of controlling electric tensioners, such as those in a hybrid riser tensioning system, to provide anti-recoil capability according to one embodiment of the disclosure.

The controller of, for example, FIG. 4 may execute computer instructions stored on a non-transitory computer readable medium, such as a computer program stored on a hard disk drive, CD-ROM, or DVD. The computer instructions may cause the controller to process data received from data systems 402, 404, and/or 406 and generate control signals 414, 416, and/or 418 according to certain methods. One such method is illustrated in the flow chart of FIG. 5. FIG. 5 is a flow chart illustrating a method of controlling electric tensioners, such as those in a hybrid riser tensioning system, to provide anti-recoil capability according to one embodiment of the disclosure. A method 500 begins at block 502 with receiving first data from a first data logging system coupled to a drilling vessel. The first data may include an acceleration of the vessel, a velocity of the vessel, and/or a position of the vessel. Then, at block 504, second data is received from a second data logging system coupled to a drilling riser of the drilling vessel. The second data may include an acceleration of the drilling riser, a velocity of the drilling riser, and/or a position of the drilling riser. Next, at block 506, the first data and the second data are processed, such as by comparing the first data with the second data to determine motion of the drilling riser relative to the drilling vessel. Then, at block 508, the controller determines a tension for each of a plurality of electrical tensioners based on the first data, the second data, and/or the comparison of the first data with the second data. The tension determination at block 508 may be selected to satisfy certain mathematical cost functions. The tension determination at block 508 may be selected to control a position of the drilling riser with respect to a reference point. The reference point may be, for example, the drilling vessel, a node along the riser string, a remotely-operated vehicle (ROV), another separate vehicle, or a seabed. The tension determination of block 508 may be determined by a controller configured to control the position of the drilling riser in a PID control loop, a linear quadratic Gaussian control loop, an H-infinity control loop, or a non-linear control loop.

Figure 6:
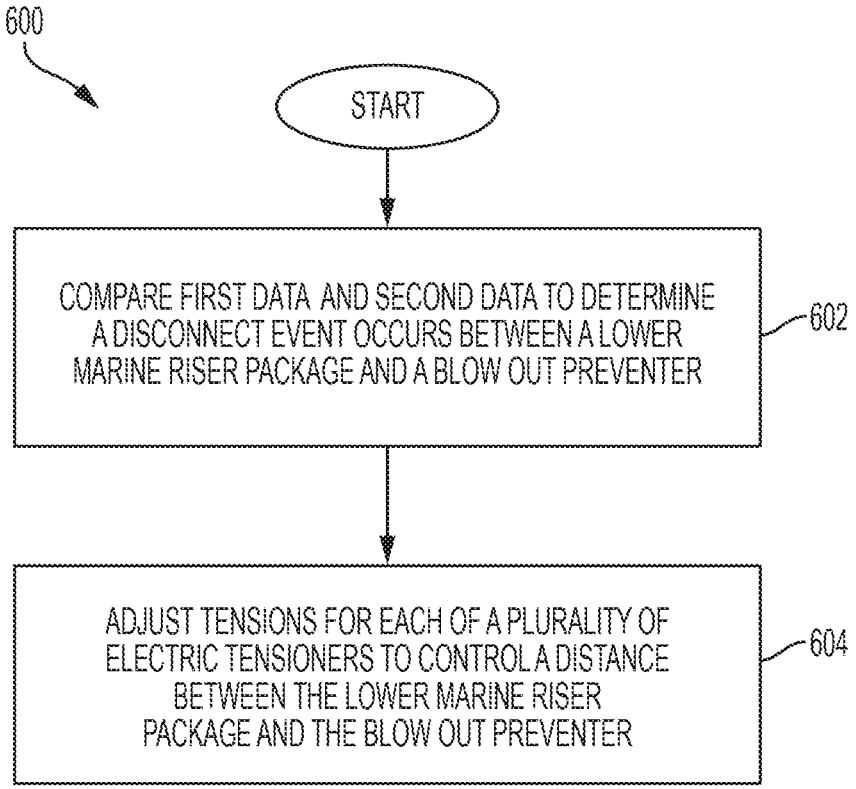
FIG. 6 is a flow chart for determining tensions for electrical tensions in a disconnect event according to one embodiment of the disclosure.

In determining the tensions for each of the electrical tensioners at block 508, the controller may select certain tension values for the electric tensioners based on events that are determined to be occurring on the drilling vessel based on the comparison of the first data and the second data. For example, a disconnect event may be detected by comparing the first data and the second data and tensions assigned to electric tensioners to compensate for the disconnect. FIG. 6 is a flow chart for determining tensions for electrical tensions in a disconnect event according to one embodiment of the disclosure. A method 600 begins at block 602 with comparing first data and second data to determine a disconnect event has occurred between a lower marine riser package and a blow out preventer. Then, at block 604, the tensions of the electric tensioners are adjusted to control a distance between the lower marine riser package and the blow out preventer. In one embodiment, the controller may distribute a maximum tension to the first and the second wires upon detection of a disconnect between a lower marine riser package and a blowout preventer for a period of time calculated based, at least in part, on a position of the blowout preventer and the second data.

Figure 7:
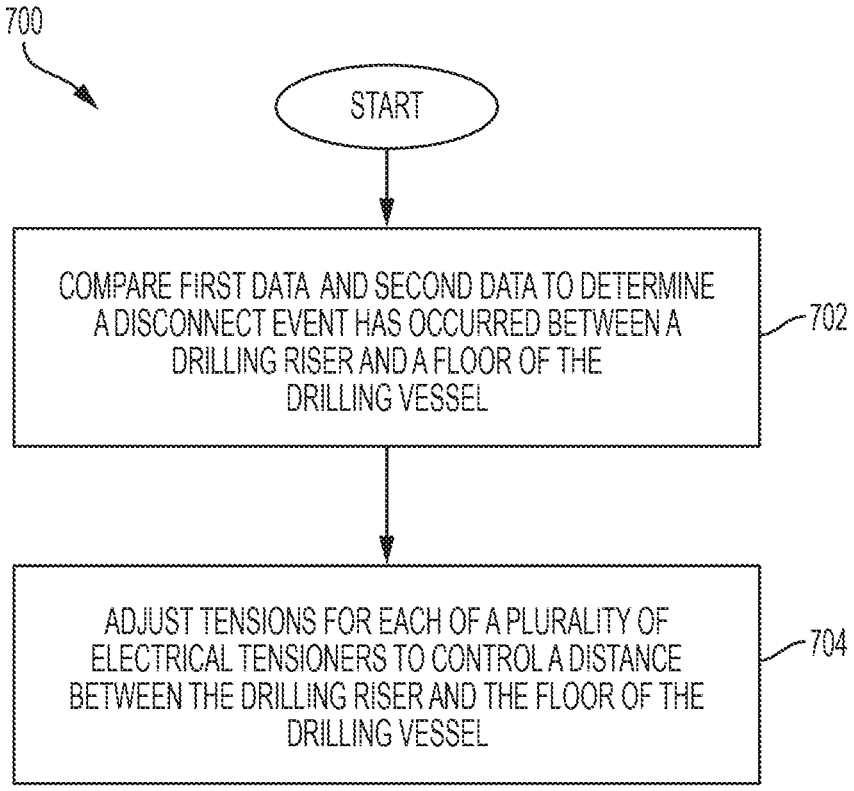
FIG. 7 is another flow chart for determining tensions for electrical tensioners to compensate for a disconnect event according to one embodiment of the disclosure.

FIG. 7 is another flow chart for determining tensions for electrical tensioners to compensate for a disconnect event according to one embodiment of the disclosure. A method 700 begins at block 702 with comparing first data and second data to determine a disconnect event has occurred between a drilling riser and a floor of the drilling vessel. In one embodiment, the comparison may include comparing the acceleration of the vessel with the acceleration of the top of the drilling riser in order to detect a possible collision. Then, at block 704, the tensions of the electric tensioners are adjusted to control a distance between the drilling riser and the floor of the drilling vessel. In one embodiment, the controller may reduce the tension applied to the first and the second wires based, at least in part, on the first data and the second data in order to keep the drilling riser from impacting a floor of the vessel. In another embodiment, the controller may reduce the tension applied to the first and the second wires if the difference between the acceleration of the top of the drilling riser and the acceleration of the vessel exceeds a threshold.

Figure 8:
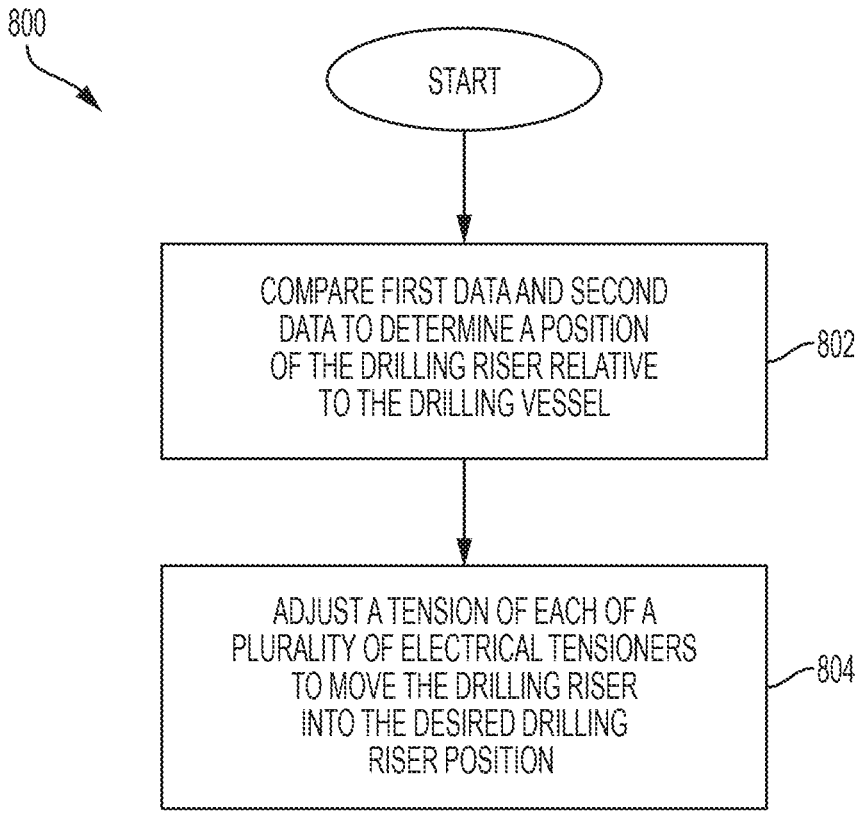
FIG. 8 is another flow chart for determining tensions for electrical tensioners to obtain a desired drilling riser position according to one embodiment of the disclosure.

FIG. 8 is another flow chart for determining tensions for electrical tensioners to obtain a desired drilling riser position according to one embodiment of the disclosure. A method 800 begins at block 802 with comparing first data and second data to determine a position of the drilling riser relative to the drilling vessel. Then, at block 804, the controller may increase the tension applied to each of a plurality of wires by a plurality of electric tensioners for a time period based, at least in part, on a desired drilling riser position and the second data in order to move the drilling riser into the desired drilling riser position.

Figure 9:
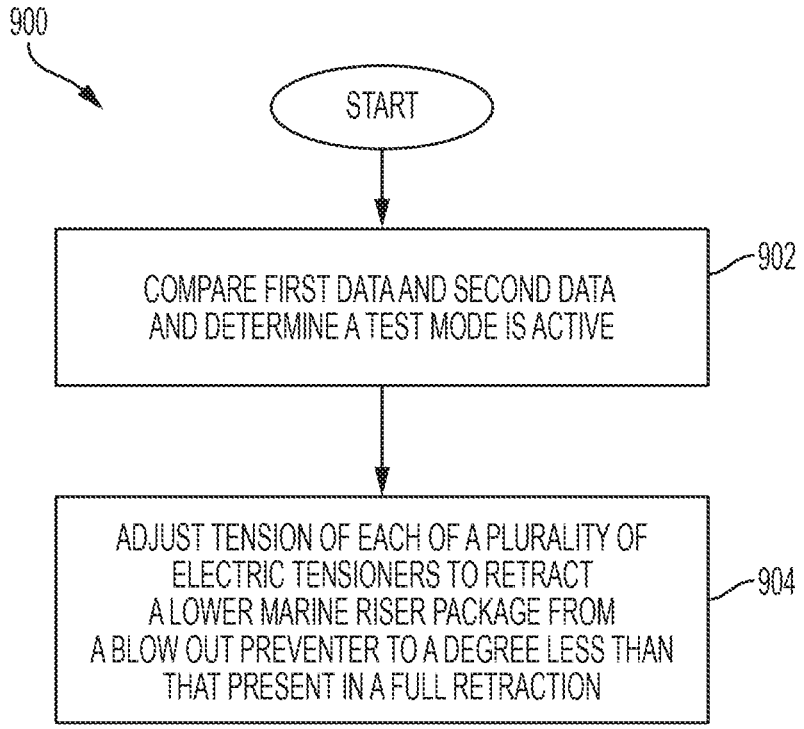
FIG. 9 is another flow chart for determining tensions for electrical tensioners in a testing mode according to one embodiment of the disclosure.

FIG. 9 is another flow chart for determining tensions for electrical tensioners in a testing mode according to one embodiment of the disclosure. A method 900 begins at block 902 with comparing first data and second data and determining that a test mode is active. Then, at block 904, the controller may retract a lower marine riser package from a blowout preventer to a degree less than that present in a full retraction. In one embodiment, the controller may adjust the degree of retraction of the lower marine riser package based, at least in part, on an adjustable control parameter.

Figure 10:
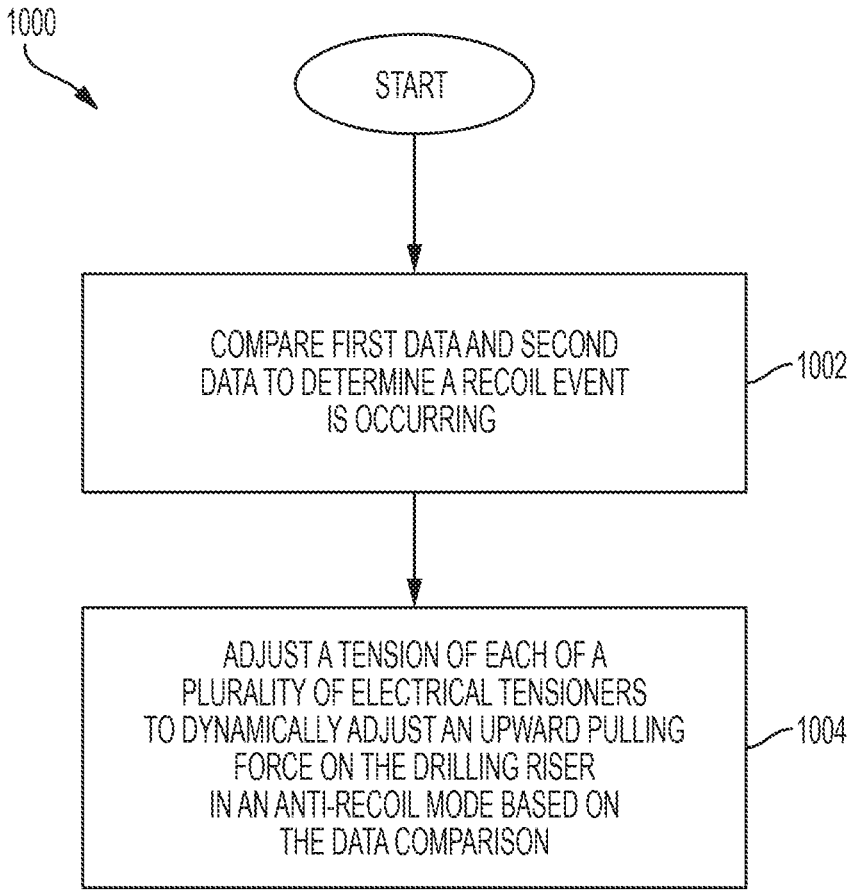
FIG. 10 is another flow chart for determining tensions for electrical tensioners in an anti-recoil mode according to one embodiment of the disclosure.

FIG. 10 is another flow chart for determining tensions for electrical tensioners in an anti-recoil mode according to one embodiment of the disclosure. A method 1000 begins at block 1002 with comparing first data and second data to determine a recoil event is occurring. Then, at block 1004, the controller may dynamically adjust an upward pulling force on the drilling riser in an anti-recoil mode based, at least in part, on a real time comparison of the first data with the second data.

Certain example control methods for an electric or hybrid tensioner system are described above in FIG. 5, FIG. 6, FIG. 7, FIG. 8, FIG. 9, and FIG. 10. A more detailed mathematical model for implementing tensioner control is described below. A position control is applied here to the free traveling riser string. The control objective of this hybrid riser tensioning system is to bring the position of the riser top at a fixed height, as fast and smooth as possible, within specified boundary conditions that may change based on mode of operation of the controller and the tensioner system.

The boundary conditions could be, for example: (1) the riser bottom needs to be lifted rapidly to separate the approximation of the LMRP and the BOP in order to avoid any kind of vertical or horizontal collision of the overlap section; (2) the overshot of the riser top from the target position should be predicted and limited by varying the tension of the electrical tensioners, to prevent the telescopic joint and other items in the load path from damage, such as the drill floor; and/or (3) each wire rope of the tensioner needs to be under tension all the time, in order to avoid any slack which may cause the wire rope to jump off one of their sheaves and also may cause shock load on the rope and the tensioners.

A position control strategy is described below that can apply in these conditions. The target reference for the final equilibrium state of the overall control system is set to be the desired positions and velocities of the riser top, riser bottom and each node chosen along the riser pipe, i.e. $[X_{TR}\ V_{TR}\ V_{RN}\ X_{RN} \ldots V_{LMRP}\ X_{LMRP}]^T$. The control input of the system is set to be the motor q-axis stator voltage $v_q$. The position, velocity, and acceleration of the riser top are measured and fed-back through the data logging device. An estimator of the riser string dynamic motion can be built using a Kalman filter. In one embodiment, a Linear-Quadratic Regulator (LQR) technique may be implemented in the controller to produce a linear dynamic feedback control law that is easy to compute and implement in industrial hardware. An LQG controller has the advantage of good disturbance attenuation and robust performance. The controller may be configured to determine an optimal control input given by:

$$\tilde{u}(t)=v_q(t),$$

which minimizes the cost function given by:

$$J=\int_0^\infty(\tilde{x}(t)^TQ\tilde{x}(t)+\tilde{u}(t)^TR\tilde{u}(t))dt,$$

where the value of matrices Q and R, as constant weighting matrices, are selected or determined, such as by a trial and error method, and may be programmed into the controller prior to normal operation of the tensioner system or calculated in real time by the controller. Q is a diagonal matrix of the size of the $\tilde{x}(t)$ with $Q(1,1)=2\times10^6$, $Q(2,2)=2\times10^5$, and $R=1\times10^{-5}$. The optimal control lay that minimizes the cost function for any initial state may be given by:

$$\tilde{u}(t)=-K_r\tilde{x}(t),$$

where the feedback matrix, $K_r$, may be given by:

$$K_r=R^{-1}B^TX,$$

where $X=X^T>=0$ is the unique solution of the algebraic Riccati equation:

$$A^TX+XA-XBR^{-1}B^TX+Q=0.$$

Because the state space variables are not directly accessible, a Kalman filter may be constructed to find an optimal estimate $\hat{x}$ of the state $\tilde{x}$ from the system output $\tilde{y}$. The required solution to the LQR problem is then found by replacing $\tilde{x}$ by $\hat{x}$. The observer can be described as:

$$\dot{\hat{x}}=A\hat{x}+B\tilde{u}^*+K_f(\tilde{y}-C\hat{x}).$$

The optimal choice of $K_f$ is then given by:

$$K_f=YC^TV^{-1},$$

where $Y=Y^T>=0$ is the unique solution of the algebraic Riccati equation:

$$YA^T+AY-YC^TV^{-1}CY+W=0.$$

Figure 11:
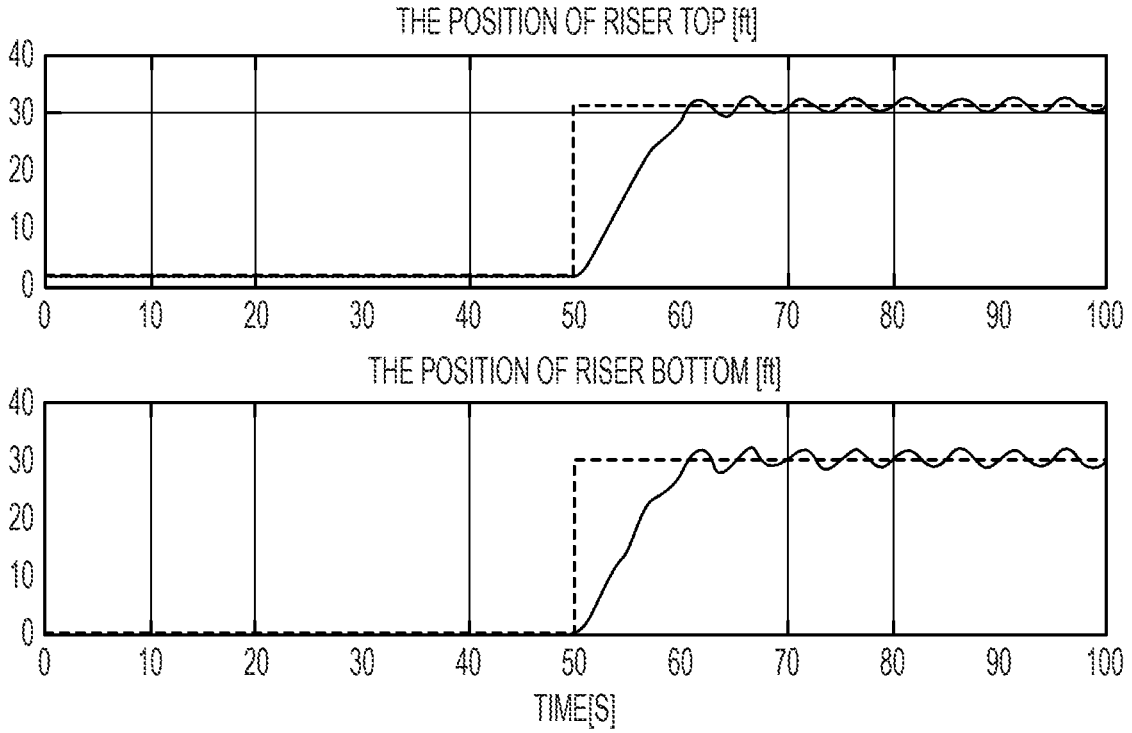
FIG. 11 are graphs showing the performance of the anti-recoil control by using only the hydro-pneumatic tensioners.
Figure 12:
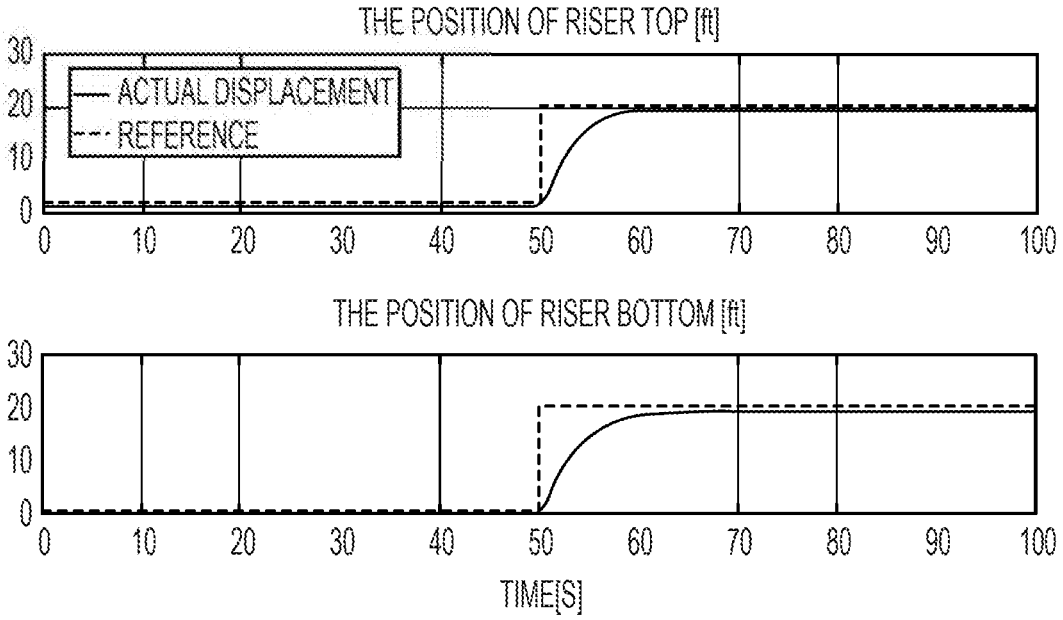
FIG. 12 are graphs showing the performance of anti-recoil control by using a riser hybrid tensioning system according to one embodiment of the disclosure.

Simulations have been performed to compare the operation of systems with electric tensioners to those of conventional hydro-pneumatic tensioners for various situations. FIG. 11 are graphs showing the performance of the anti-recoil control by using only the hydro-pneumatic tensioners. The retrieve distance is preset to be 30 feet for every anti-recoil operation, before launching in service, so that is not adjustable for different operating condition. FIG. 12 are graphs showing the performance of anti-recoil control by using a riser hybrid tensioning system according to one embodiment of the disclosure. The target displacement of any part of the riser string can be set to a certain position with respect to the sea bed, by simply typing the value into control firmware. In this simulation, the LMRP is set to lift 20 feet from the BOP. The LMRP is disconnected from the BOP at 50 seconds. It took 12 seconds for the riser string to stabilize into a new position without overshot, which is about the same time duration for the hydro-pneumatic tensioners, as shown in FIG. 12.

Figure 13:
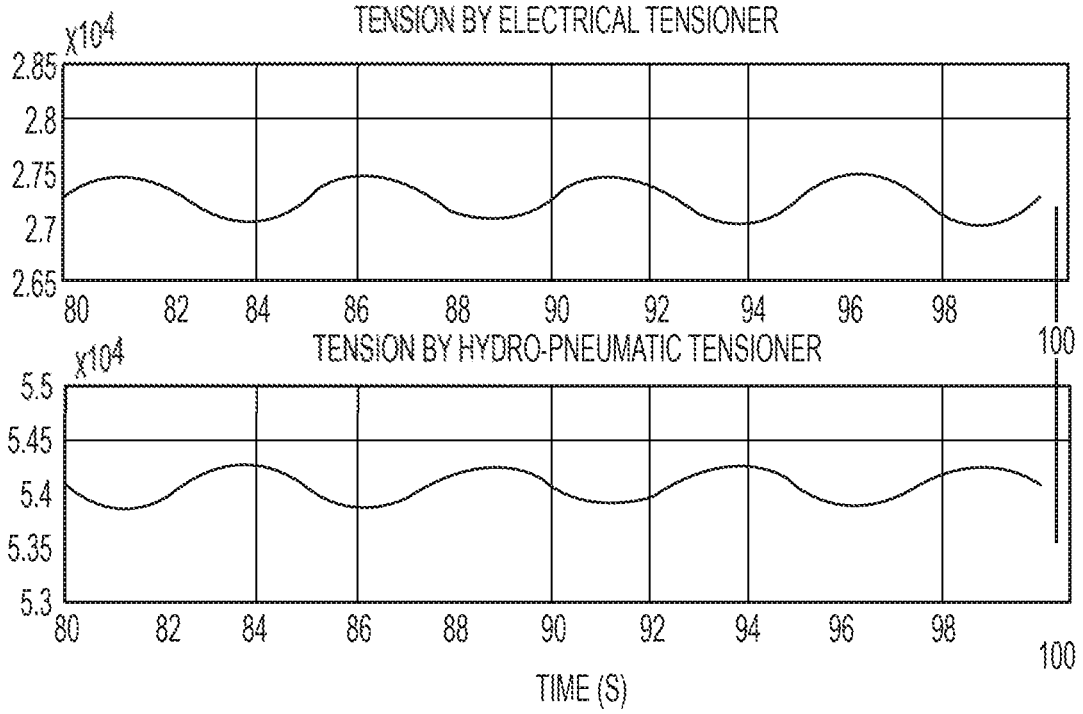
FIG. 13 are graphs showing the tension delivered by electrical and hydro-pneumatic tensioners during a specific time period according to one embodiment of the disclosure.

From 60 seconds and later in FIG. 11, the riser string is under constant oscillation, after the riser is retrieved and soft hang-off on hydro-pneumatic tensioners. This riser system behavior is dangerous and unavoidable when using only hydro-pneumatic tensioners. This oscillation exposes the choke and kill line seals to severe wear and tear, and usually is not permitted to last long under harsh weather or other conditions. However, by using the hybrid tensioning system, the tension delivered by electrical tensioners is able to compensate the tension variation on the hydro-pneumatic tensioners with an approximately equal signal having a 180° phase offset, as shown in FIG. 13. The riser string may be constantly under position control mode, which allows the riser to be free hanging in water without position or tension fluctuation. The same level of tension compensation may also apply to the active heave compensation operation, when the riser bottom is connected on the wellhead. This active heave compensation operation is described in U.S. Patent Publication No. 2014/0010596 to Wu et al. filed on Dec. 14, 2012, which is hereby incorporated by reference.

Figure 14:
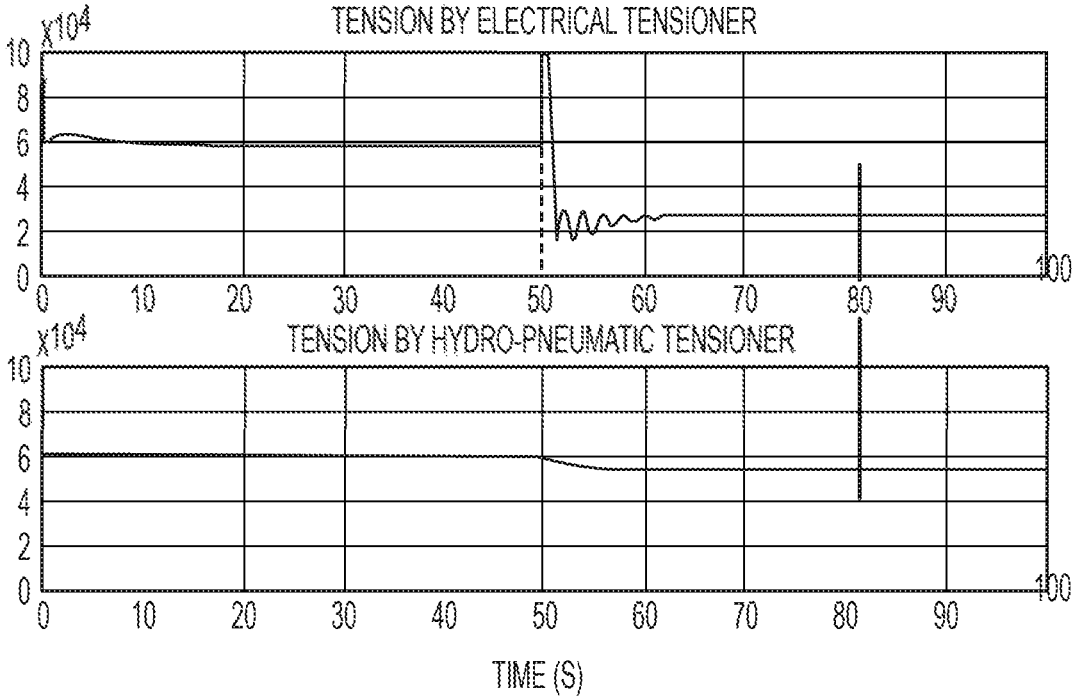
FIG. 14 are graphs showing the tension delivered by electrical and hydro-pneumatic tensioners during another time period according to one embodiment of the disclosure.

FIG. 14 are graphs illustrating that the tension delivered by electrical tensioners is increased to its maximum value, so that it lifts the riser bottom from BOP fast and straight to avoid any collision or damage, according to one embodiment of the disclosure. Then the tension is reduced rapidly to decelerate the riser string from hitting the drill floor. Then, the tension would increase gradually until it reaches the target position. The tension oscillation on the electrical tensioner from 52-60 seconds appears because the feedback controller was trying to correct the error produced by the state estimator.

Figure 15:
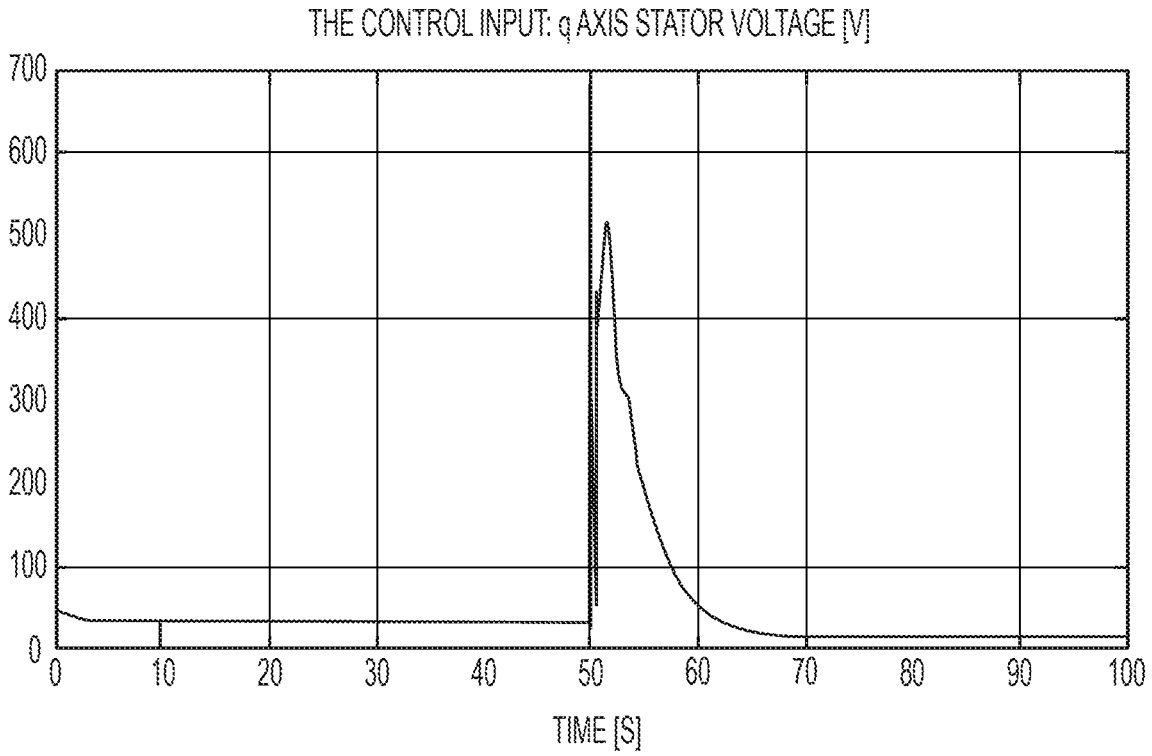
FIG. 15 is a graph showing a control input for moto stator q-axis voltage according to one embodiment of the disclosure.
Figure 16:
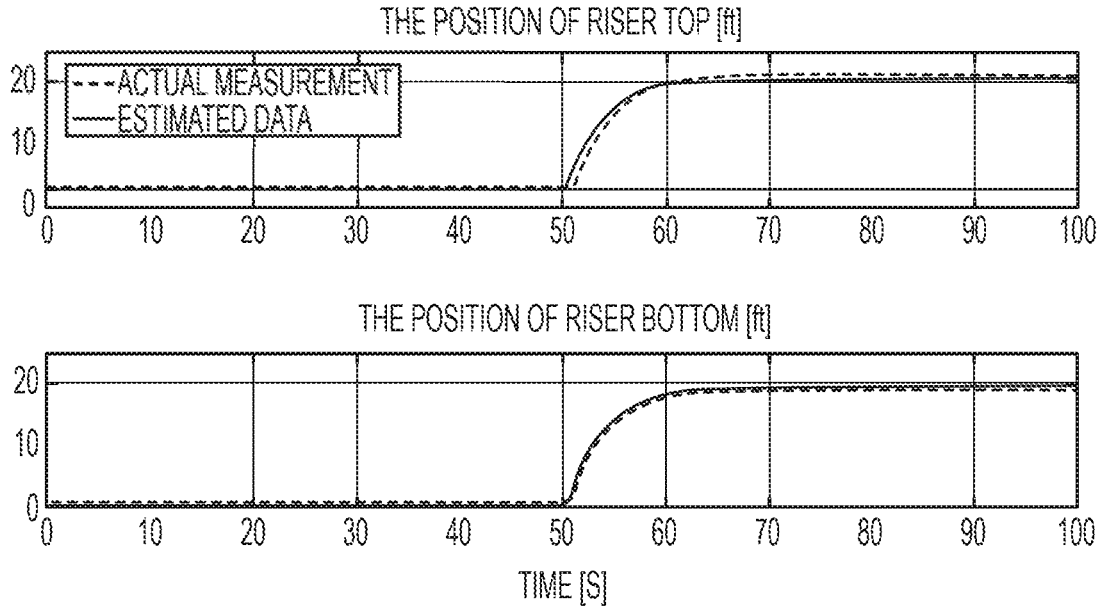
FIG. 16 are graphs showing a measured and estimated position of riser top and bottom according to one embodiment of the disclosure.

The motor stator q-axis voltage, as system control input, is shown in FIG. 15. A voltage peak is expected during recoil process, which illustrates the electrical energy peak fluctuation expected for the vessel power system. The results of the Kalman estimator, as shown in FIG. 16, demonstrate the effectiveness of the riser system math model as the estimated and actual position of the riser top and riser bottom.

A tensioning system built using electric tensioners, such as a hybrid riser tensioning system, can be controlled to obtain enhanced riser anti-recoil control capability. This improvement can increase an operating envelop of a drilling vessel. That is, better anti-recoil control allows the drilling vessel to operate in a larger range of conditions, and thus extract more oil from underground reservoirs in the same amount of operating time. Thus, the drilling vessels can be more efficiently and profitably operated. By using the riser hybrid tensioning system, the whole riser package can become a predictable and testable system with lower risk. Further, the better control system reduces potential damage to the drilling vessel when unexpected events occur and increases an operator's confidence. The data logging system improves the detectability of events that can be compensated for by the anti-recoil system. The position control capability offered by the electric tensioners when the riser string soft hang-off on the tensioners opens the possibility to extend the operability to other operations, such as, controlling riser string behavior during vessel movement among different well heads.

A controller may receive logged data from the data logging system and control operation of tensioners based on a system model integrating both electrical and hydro-pneumatic tensioners and the riser string for anti-recoil control purpose. A Linear-Quadratic Gaussian (LQG) control design technique can be implemented by the controller to improve position control of the riser string. Further, the controller may include a feedback mechanism with a system state variable estimator. Simulation demonstrate that the anti-recoil control techniques described herein provide a more robust and accurate control performance.

The schematic flow chart diagrams of FIG. 3, FIG. 5, FIG. 6, FIG. 7, FIG. 8, FIG. 9, and FIG. 10 are generally set forth as a logical flow chart diagram. As such, the depicted order and labeled steps are indicative of aspects of the disclosed method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagram, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

If implemented in firmware and/or software, functions described above may be stored as one or more instructions or code on a computer-readable medium. Examples include non-transitory computer-readable media encoded with a data structure and computer-readable media encoded with a computer program. Computer-readable media includes physical computer storage media. A storage medium may be any available medium that can be accessed by a computer. By way of example, and not limitation, such computer-readable media can comprise random access memory (RAM), read-only memory (ROM), electrically-erasable programmable read-only memory (EEPROM), compact disc read-only memory (CD-ROM) or other optical disk storage, magnetic disk storage or other magnetic storage devices, or any other medium that can be used to store desired program code in the form of instructions or data structures and that can be accessed by a computer. Disk and disc includes compact discs (CD), laser discs, optical discs, digital versatile discs (DVD), floppy disks and Blu-ray discs. Generally, disks reproduce data magnetically, and discs reproduce data optically. Combinations of the above should also be included within the scope of computer-readable media.

In addition to storage on computer readable medium, instructions and/or data may be provided as signals on transmission media included in a communication apparatus. For example, a communication apparatus may include a transceiver having signals indicative of instructions and data. The instructions and data are configured to cause one or more processors to implement the functions outlined in the claims.

Although the present disclosure and certain representative advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. An apparatus, comprising:

a drilling riser;

a plurality of wires coupled to the drilling riser;

a first and a second electrical tensioner coupled to the drilling riser via a first and a second wire of the plurality of wires, respectively;

a first data logging system configured to be coupled to a vessel and configured to generate first data regarding properties of the vessel;

a second data logging system coupled to the drilling riser, configured to generate second data regarding properties of the riser; and a controller coupled to the first and the second electrical tensioners and coupled to the first and the second data logging systems and configured to perform steps comprising:

receiving the first data from the first data logging system;

receiving the second data from the second data logging system;

comparing the first data with the second data; and determining a tension for the first and the second electrical tensioners based, at least in part, on a comparison of the first data with the second data to control a position of the drilling riser with respect to a reference point; and controlling the first and the second electrical tensioners to apply the determined tension to the first and the second wires, in which the controller is further configured, when in a testing mode, to retract a lower marine riser package from a blowout preventer without disconnecting the lower marine riser package from the blowout preventer.

2. The apparatus of claim 1, further comprising:

a hydro-pneumatic tensioner coupled to the drilling riser via a third wire of the plurality of wires, in which the controller is further configured to control the hydro-pneumatic tensioner to adjust a tension of the third wire.

3. The apparatus of claim 2, in which the hydro-pneumatic tensioner comprises an anti-recoil valve.

4. The apparatus of claim 3, in which the controller is configured to control the anti-recoil valve of the hydro-pneumatic tensioner to be kept open during a riser recoil process to enhance predictability of a riser system.

5. The apparatus of claim 3, in which the controller is further configured to close the anti-recoil valve of the hydro-pneumatic tensioner to supplement anti-recoil capabilities of the first and the second electrical tensioners.

6. The apparatus of claim 1, in which the second data comprises at least one of:

an acceleration of a top of the drilling riser;

a velocity of the top of the drilling riser;

a position of the top of the drilling riser; and a tension measurement, and in which the first data comprises at least one of:

an acceleration of the vessel;

a velocity of the vessel; and a position of the vessel.

7. The apparatus of claim 1, in which the controller is further configured to adjust the tensions of the first and the second electrical tensioners to control a distance between the lower marine riser package and the blowout preventer in case of a disconnect between the lower marine riser package and the blowout preventer.

8. The apparatus of claim 1, in which the controller is further configured to adjust the tensions of the first and the second electrical tensioners to control a distance between the drilling riser and a floor of the vessel in an event of a disconnect between the lower marine riser package and the blowout preventer.

9. The apparatus of claim 1, in which the controller is further configured to distribute a maximum tension to the first and the second wires upon detection of a disconnect between the lower marine riser package and the blowout preventer for a period of time calculated based, at least in part, on a position of the blowout preventer and the second data.

10. The apparatus of claim 1, in which the controller is further configured to reduce the tension applied to the first and the second wires based, at least in part, on the first data and the second data in order to keep the drilling riser from impacting a floor of the vessel.

11. The apparatus of claim 10, in which the first data comprises an acceleration of the vessel and the second data comprises an acceleration of a top of the drilling riser, and in which the controller is further configured to compare the acceleration of the vessel with the acceleration of the top of the drilling riser in order to detect a possible collision.

12. The apparatus of claim 11, in which the controller is further configured to reduce the tension applied to the first and the second wires if a difference between the acceleration of the top of the drilling riser and the acceleration of the vessel exceeds a threshold.

13. The apparatus of claim 1, in which the controller is further configured to increase the tension applied to the first and the second wires for a time period based, at least in part, on a desired drilling riser position and the second data in order to move the drilling riser into the desired drilling riser position.

14. The apparatus of claim 13, in which the controller is further configured to adjust a degree of retraction of the lower marine riser package based, at least in part, on an adjustable control parameter.

15. The apparatus of claim 1, in which the controller is further configured to control the first and the second electrical tensioners to dynamically adjust an upward pulling force on the drilling riser in an anti-recoil mode based, at least in part, on a real time comparison of the first data with the second data.

16. The apparatus of claim 1, in which the controller is further configured to control tensions of the first and the second wires by applying an optimization control technique.

17. The apparatus of claim 1, wherein the reference point comprises at least one of the vessel, a node along a riser string, another separate vessel, and a seabed.

18. The apparatus of claim 1, wherein the controller is configured to control the position of the drilling riser according to at least one of a PID control loop, a Linear Quadratic Gaussian control loop, an H-infinity control loop, and a non-linear control loop.

* * * * *